US009385451B2

(12) United States Patent
Mukunoki et al.

(10) Patent No.: US 9,385,451 B2
(45) Date of Patent: Jul. 5, 2016

(54) CONNECTOR HOUSING, ELECTRIC CONNECTOR AND METHOD OF INSERTING CONNECTOR TERMINAL INTO CONNECTOR HOUSING

(71) Applicant: DAI-ICHI SEIKO CO., LTD., Kyoto (JP)

(72) Inventors: Jun Mukunoki, Shizuoka (JP); Takuya Takeda, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/460,538

(22) Filed: Aug. 15, 2014

(65) Prior Publication Data

US 2015/0064940 A1 Mar. 5, 2015

(30) Foreign Application Priority Data

Aug. 30, 2013 (JP) ..... 2013-180258

(51) Int. Cl.

| | |
|---|---|
| ***H01R 12/00*** | (2006.01) |
| ***H01R 12/70*** | (2011.01) |
| ***H01R 13/436*** | (2006.01) |
| *H01R 12/52* | (2011.01) |
| *H01R 12/58* | (2011.01) |

(Continued)

(52) U.S. Cl.

CPC ..... *H01R 12/7005* (2013.01); *H01R 13/436* (2013.01); *H01R 12/523* (2013.01); *H01R 12/585* (2013.01); *H01R 12/7023* (2013.01); *H01R 12/7082* (2013.01); *H01R 12/91* (2013.01); *H01R 13/17* (2013.01); *Y10T 29/49218* (2015.01)

(58) Field of Classification Search

CPC ..... H01R 12/7005; H01R 12/7082; H01R 12/91; H01R 12/7023; H01R 12/585; H01R 12/523; H01R 12/68; H01R 12/69; H01R 12/52; H01R 12/58; H01R 12/70; H01R 13/422; H01R 13/4361; H01R 13/17; H05K 3/326

USPC ..... 439/65, 66, 74, 75, 82, 751

See application file for complete search history.

(56) References Cited

U.S. PATENT DOCUMENTS

| | | | | |
|---|---|---|---|---|
| 4,941,836 | A * | 7/1990 | Bormuth | 439/247 |
| 5,328,381 | A * | 7/1994 | Seymour et al. | 439/247 |

(Continued)

FOREIGN PATENT DOCUMENTS

| | | |
|---|---|---|
| EP | 2 685 566 | 1/2014 |
| JP | 63-266786 | 11/1988 |

(Continued)

OTHER PUBLICATIONS

European Search Report (ESR) issued Sep. 24, 2014 in corresponding European Patent Application No. EP 14 18 1361.

*Primary Examiner* — Amy Cohen Johnson
*Assistant Examiner* — Milagros Jeancharles
(74) *Attorney, Agent, or Firm* — Wenderoth, Lind & Ponack, L.L.P.

(57) ABSTRACT

A connector housing includes a terminal housing in which at least one connector terminal electrically connecting two printed circuit boards to each other is housed. The terminal housing includes a holder for holding the at least one connector terminal therewith, the holder being elastically deformable in accordance with a displacement of the at least one connector terminal.

15 Claims, 17 Drawing Sheets

(51) Int. Cl.
*H01R 12/91* (2011.01)
*H01R 13/17* (2006.01)

(56) References Cited

U.S. PATENT DOCUMENTS 5,340,319 A 8/1994 Enomoto et al.
6,409,525 B1 * 6/2002 Hoelscher et al. ..... 439/140
7,828,571 B2 * 11/2010 Satoh et al. ..... 439/260
2001/0049213 A1 * 12/2001 Potters et al. ..... 439/80
2014/0017914 A1 1/2014 Endo et al.

FOREIGN PATENT DOCUMENTS

JP 1-113965 7/1989
JP 7-230862 8/1995

* cited by examiner

CONNECTOR HOUSING, ELECTRIC CONNECTOR AND METHOD OF INSERTING CONNECTOR TERMINAL INTO CONNECTOR HOUSING

The disclosure of Japanese Patent Application No. 2013-180258 filed on Aug. 30, 2013 including the specification, claims, drawings and summary is incorporated herein by reference in its entirety.

BACKGROUND OF THE INVENTION

1. Field of the Invention

The present invention relates to a connector housing supporting therein a connector terminal including at opposite ends thereof a pair of terminals to be inserted into through-holes formed through each of two printed circuit boards located facing each other, to thereby electrically connect the two printed circuit boards to each other. The present invention relates further to an electric connector including the connector housing, and further to a method of inserting a connector terminal into a connector housing.

2. Description of the Related Art

There is known an electric connector supporting thereon a plurality of connector terminals in a line. The connector terminals are inserted at one of ends thereof into through-holes formed through a first printed circuit board, and at the other end thereof into through-holes formed through a second printed circuit board, to thereby electrically connect circuits mounted on the first and second printed circuit boards to each other.

FIG. 18 illustrates a pin header 100 suggested in Japanese Patent Application Publication No. H7 (1985)-230862.

The illustrated pin header 100 includes a plurality of connector terminals 101, and a connector holder. The connector holder includes a board 104, an upper bar 102 horizontally extending along an upper end of the board 104, a lower bar 103 horizontally extending along a lower end of the board 104, and a plurality of protrusions 105 horizontally aligned at a middle of the board 104. The connector terminals 202 are supported by the upper bar 203 and the lower bar 204. The protrusions 205 are located in gaps formed between the adjacent connector terminals 101 to thereby electrically insulate the adjacent connector terminals 101 to each other.

In an electric connector including a plurality of connector terminals through which printed circuit boards are electrically connected to each other, a positional relation between the printed circuit boards is important. For instance, when connector terminals are inserted at opposite ends thereof into through-holes formed through printed circuit boards, to thereby electrically connect the printed circuit boards to each other, if a positional relation between the printed circuit boards were deflected, the connector terminals might be able to be inserted at one of ends thereof into through-holes of one of the printed circuit boards, but could not be inserted at the other end thereof into through-holes of the other of the printed circuit boards, because axes of the connector terminals are displaced relative to axes of the through-holes. In particular, in the case that a plurality of electric connectors is employed, it is much afraid that some of the connector terminals cannot be inserted into one of the printed circuit boards. Furthermore, if connector terminals were designed to have a smaller cross-sectional area in order to allow the connector terminals to be much resiliently deformable, the connector terminals would allow a less current to pass therethrough.

In the pin header 100 illustrated in FIG. 18, the connector terminals 101 are inserted directly into the printed circuit boards. The connector terminals 101 are fixed by the upper bar 102 and the lower bar 103, and the protrusions 105 merely separate the adjacent connector terminals 101 from each other. Accordingly, if there were deflection in a positional relation between the printed circuit boards, since positions of the connector terminals 101 and a gap between the connector terminals 101 are fixed by the upper bar 102 and the lower bar 103, even if the connector terminals 101 can be inserted into one of the printed circuit boards, the connector terminals 101 would not be able to be inserted into the other of the printed circuit boards.

SUMMARY OF THE INVENTION

In view of the above-mentioned problems in the conventional electric connectors, it is an object of the present invention to provide a connector housing capable of being inserted into through-holes of printed circuit boards, even if there were deflection between the printed circuit boards. It is further an object of the present invention to provide an electric connector capable of doing the same. It is another object of the present invention to provide a method of inserting a connector terminal into a connector housing, capable of doing the same.

In one aspect of the present invention, there is provided a connector housing including a terminal housing in which at least one connector terminal electrically connecting two printed circuit boards to each other is housed, the terminal housing including a holder for holding the connector terminal therewith, the holder being elastically deformable in accordance with a displacement of the connector terminal.

In another aspect of the present invention, there is provided an electric connector including at least one connector terminal electrically connecting two printed circuit boards to each other, and a connector housing including a terminal housing in which the connector terminal is housed, wherein the terminal housing includes a holder for holding the connector terminal therewith, the holder being elastically deformable in accordance with a displacement of the connector terminal.

In accordance with the present invention, even if there were deflection between printed circuit boards facing each other when connector terminals are inserted into through-holes of the printed circuit boards, the holder elastically deforms in accordance with the deflection between the printed circuit boards, ensuring that the connector terminals can be surely inserted into through-holes of the printed circuit boards.

It is preferable that the holder includes a first holder holding the connector terminal in a non-fixed condition, and a second holder holding the connector terminal in a fixed condition.

When a connector terminal is inserted into printed circuit boards, the connector terminal is first inserted into a printed circuit board through an end located closer to the second holder. Since the second holder supports the connector terminal in a fixed condition, there are no gaps between the connector terminal and the connector housing, and hence, the connector terminal is fixed relative to the connector housing, ensuring that the connector terminal can be smoothly and accurately inserted into the printed circuit board. In contrast, since the first holder supports a connector terminal in a non-fixed condition, there is a gap between the connector terminal and the connector housing. Accordingly, even if an axis of a connector terminal were deflected between opposite ends thereof, the connector terminal can move in the first holder within the gap between the connector terminal and the connector housing, ensuring that the connector housing can be inserted into the printed circuit board.

It is preferable that each of the first and second holders includes a pair of elastic arms, the first holder holding the connector terminal in such a manner that there is formed a gap between the connector terminal and at least one of the arms, and the second holder holding the connector terminal in such a manner that there is formed no gap between the connector terminal and the arms.

It is preferable that the connector housing further includes a projection projecting towards a space formed between the arms in the second holder, the projection having such a length that the projection makes contact with the connector terminal when the connector terminal is inserted between the arms.

The projection assists the second holder to support a connector terminal in a fixed condition.

For instance, the projection may be designed to make contact at a top thereof with the connector terminal.

Even if a connector terminal attempts to move towards the projection, the projection is difficult to be deformed, because the projection is pushed in a longitudinal direction. Accordingly, the projection restricts the movement of the connector terminal, and the connector terminal is kept fixed in the second holder.

As an alternative, the projection may be designed to project from one of the arms towards the other of the arms, in which case, the projection makes contact at a side thereof with the connector terminal.

In still another aspect of the present invention, there is provided a method of inserting a connector terminal into a connector housing, the connector terminal electrically connecting two printed circuit boards to each other, the connector housing including a terminal housing in which the connector terminal is housed, the method including inserting the connector terminal into a holder formed at the terminal housing, the holder being made of elastic material, and elastically deforming the holder in accordance with a displacement of the connector terminal to thereby cause the holder to hold the connector terminal.

Even if there were deflection in a positional relation between printed circuit boards facing each other, when connector terminals are inserted into the printed circuit boards, the holder holding the connector terminals is elastically deformed in accordance with the deflection, ensuring that the connector terminals can be surely inserted into through-holes of the printed circuit boards.

The advantages obtained by the aforementioned present invention will be described hereinbelow.

In accordance with the present invention, even if there were deflection in a positional relation between printed circuit boards, the holder elastically deforms in line with the deflection. Thus, connector terminals can be surely inserted into the printed circuit boards.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

The electric connector in accordance with the preferred embodiment of the present invention is explained hereinbelow with reference to the drawings. In the specification, a side at which connector terminals are located is defined as a front, and a side opposite to the front is defined as a rear.

Figure 1:
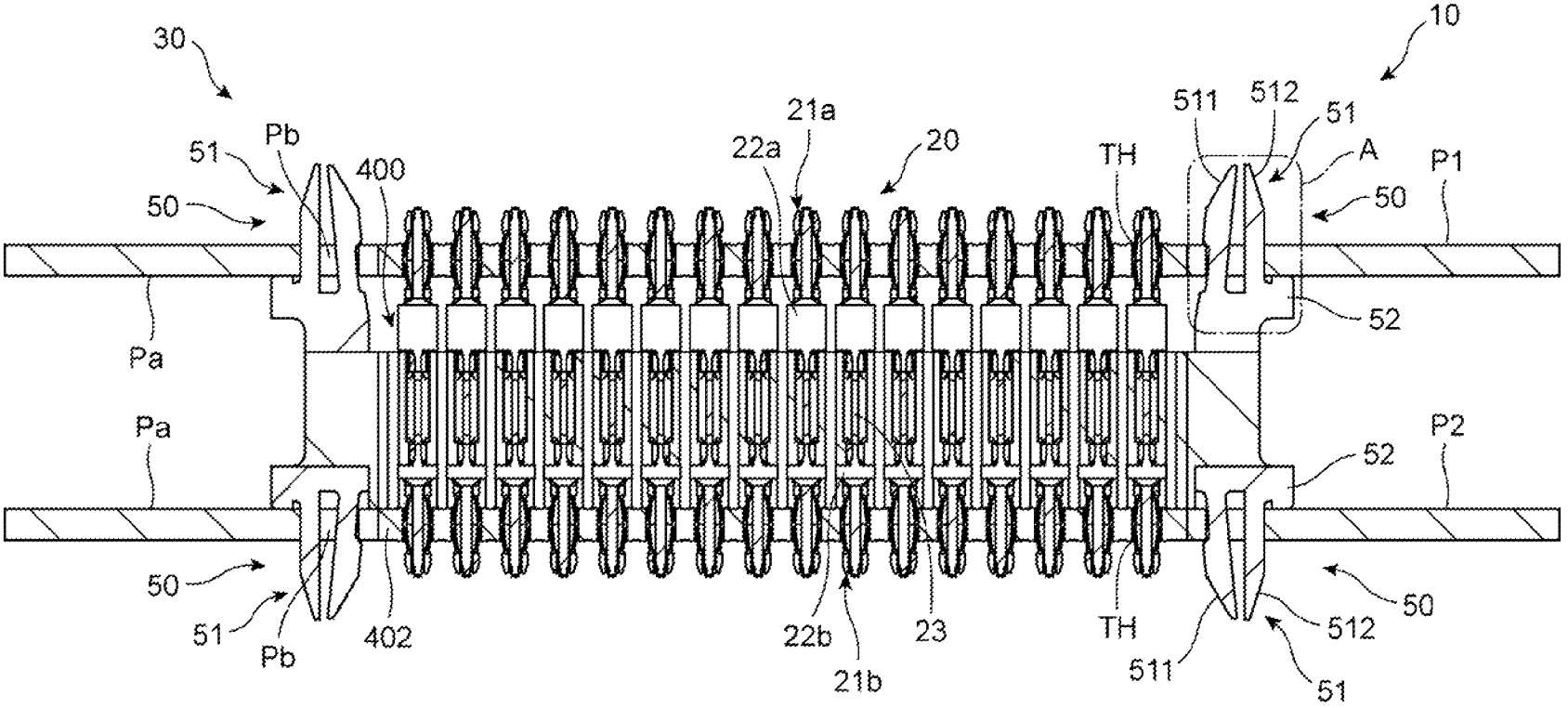
FIG. 1 is a cross-sectional view of the electric connector in accordance with the first embodiment of the present invention through which two printed circuit boards are electrically and mechanically connected to each other.
Figure 2:
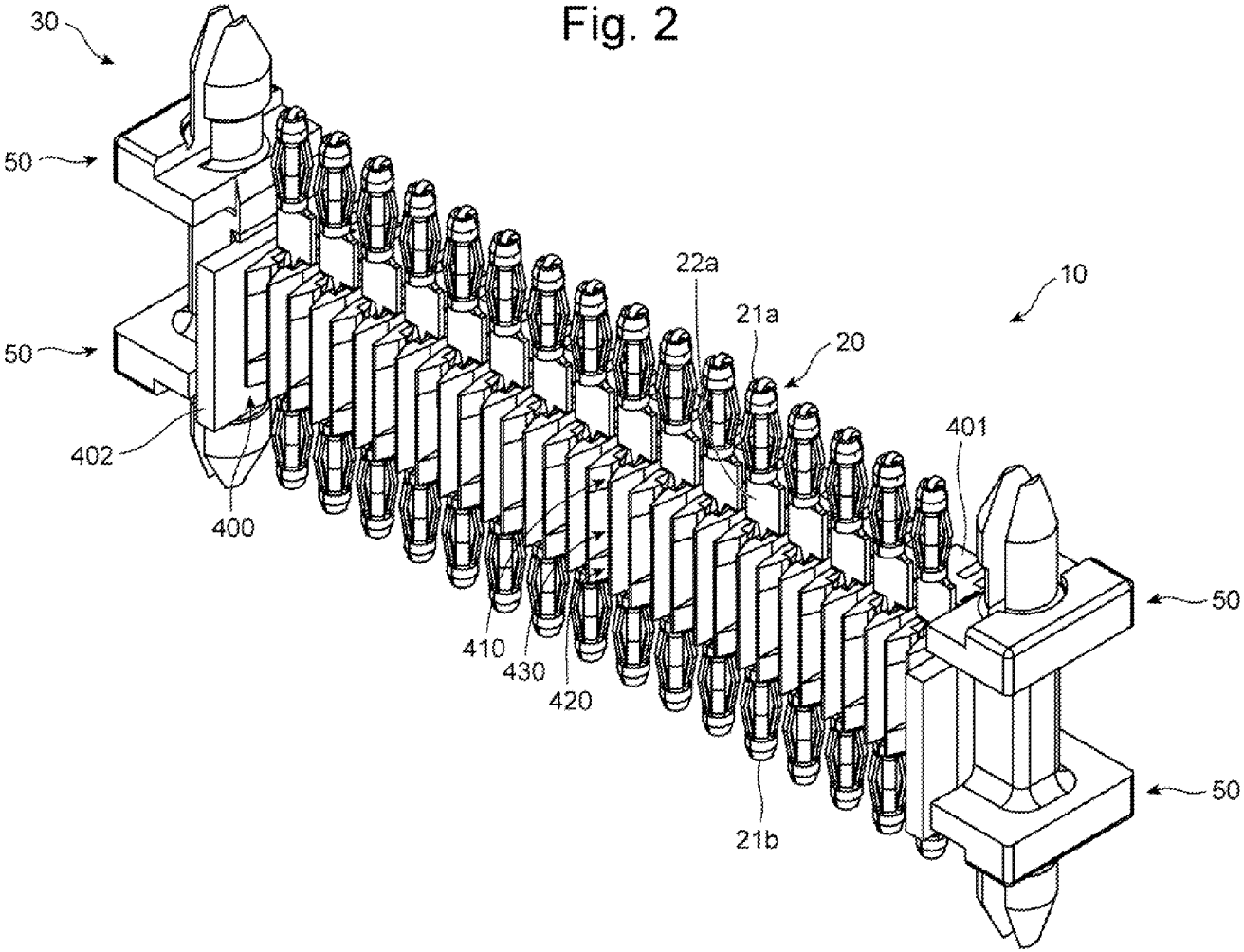
FIG. 2 is an upper perspective view of the electric connector in accordance with the first embodiment of the present invention.
Figure 3:
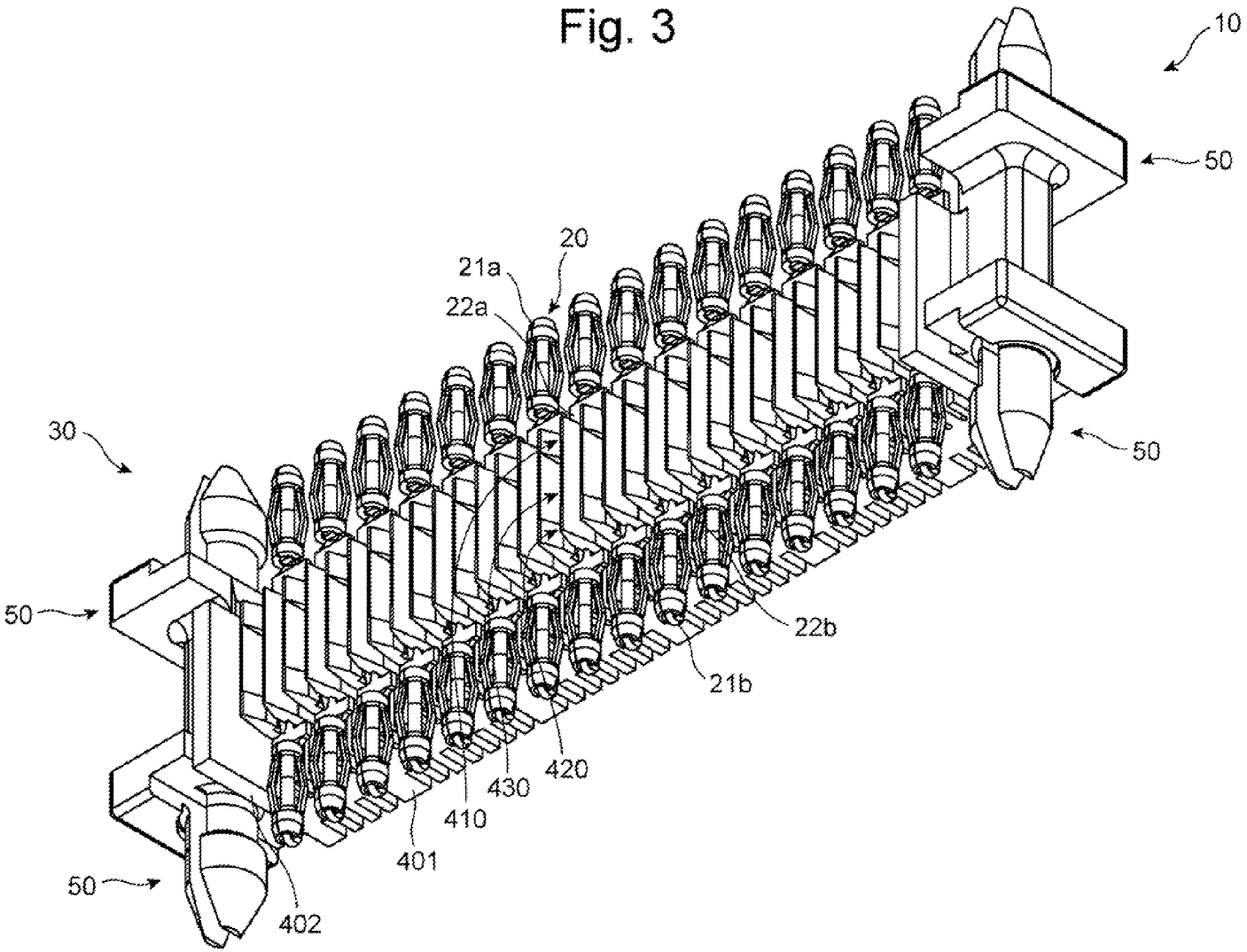
FIG. 3 is a lower perspective view of the electric connector in accordance with the first embodiment of the present invention.

The electric connector 10 in accordance with the first embodiment, illustrated in FIGS. 1 to 3, is equipped in an automobile for electrically connecting two printed circuit boards P1 and P2 (see FIG. 1) facing each other, to each other.

The electric connector 10 includes a plurality of connector terminals 20 each in the form of a bar, and a connector housing 30 supporting the connector terminals 20 in a line.

Figure 4:
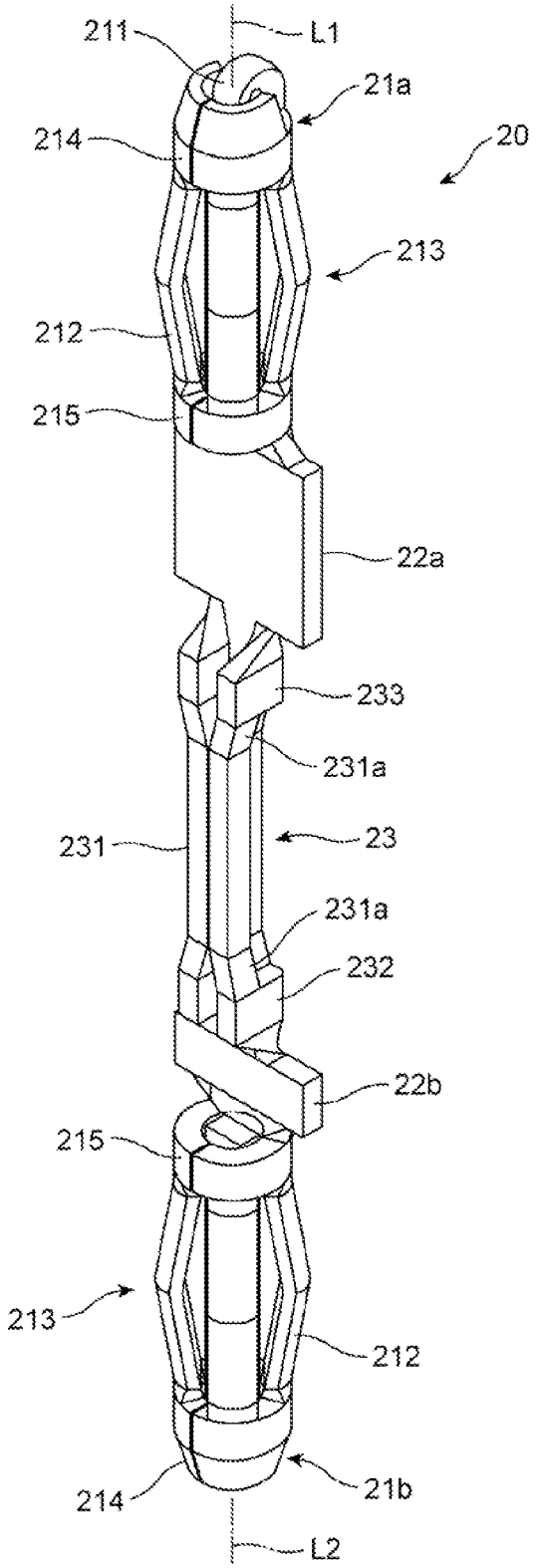
FIG. 4 is a perspective view of the connector terminal defining a part of the electric connector in accordance with the first embodiment of the present invention.

Each of the connector terminals 20 illustrated in FIG. 4 includes first and second press-fit terminals 21*a* and 21*b* at opposite ends, first and second projecting portions 22*a* and 22*b* restricting the connector terminal 20 in the movement in a length-wise direction of the connector terminal 20, and a buffer portion 23 deformable in accordance with deflection between an imaginary longitudinal center line L1 of the first press-fit terminals 21*a* and an imaginary longitudinal center line L2 of the second press-fit terminal 21*b*. The connector terminal 20 is inserted through the first and second press-fit terminals 21*a* and 21*b* into through-holes TH (see FIG. 1) formed through printed circuit boards P1 and P2 (see FIG. 1).

Figure 5:
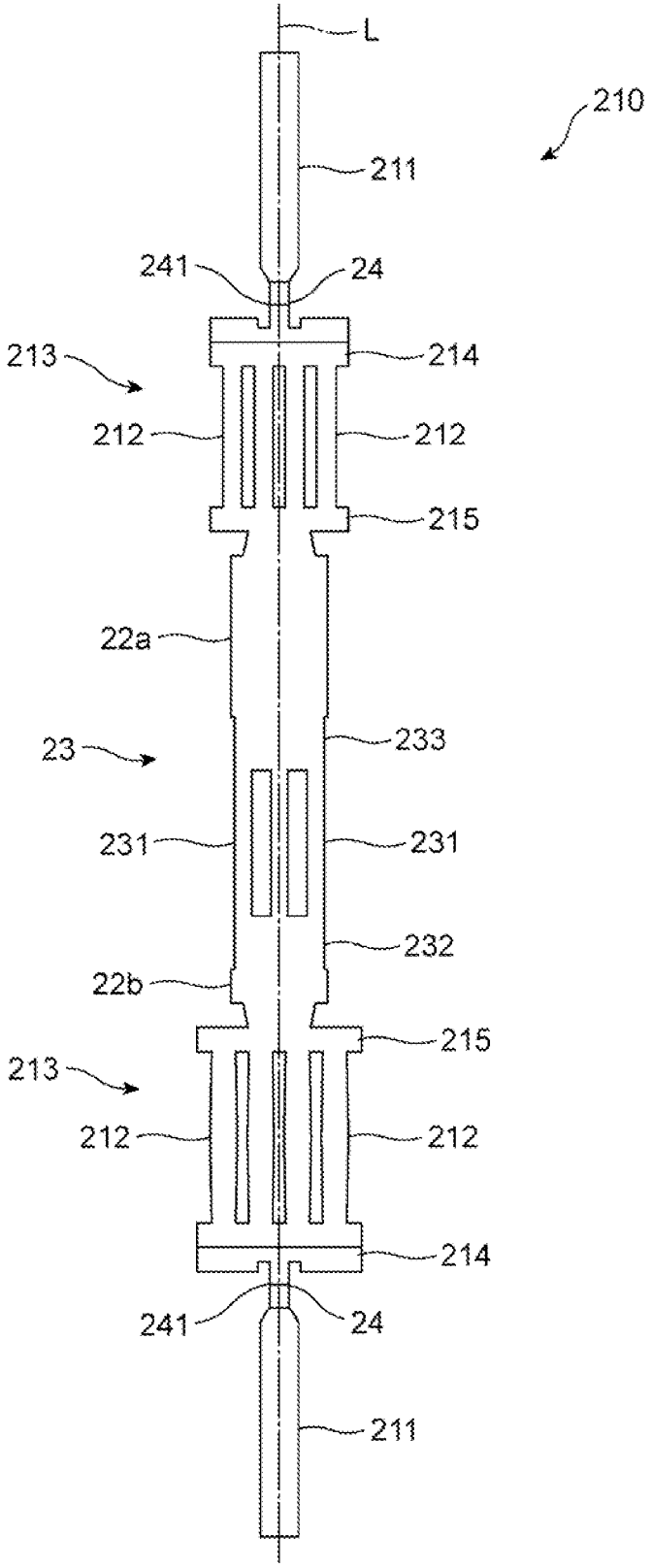
FIG. 5 is a plan view of a metal sheet of which the connector terminal illustrated in FIG. 4 is fabricated.

The connector terminal 20 can be manufactured by bending a single elastic metal plate 210 illustrated in FIG. 5.

Each of the first and second press-fit terminals 21*a* and 21*b* can be connected to the printed circuit boards P1 and P2 without being soldered. As illustrated in FIG. 4, each of the first and second press-fit terminals 21*a* and 21*b* includes a central shaft portion 211 having a U-shaped cross-section, a contact portion 213 having a plurality of ">"-shaped contact pieces 212, and binders 214 and 215. The contact pieces 212 are equally spaced away from one another and arranged to surround the central shaft portion 211 such that they extend in a length-wise direction of the connector terminal 20, and outwardly project. That is, the contact portion 213 is in the form of a barrel around the central shaft portion 211, and hence, is able to elastically increase and decrease a diameter thereof, because the contact pieces 212 are elastically deformable. The binder 214 is C-shaped to thereby bind the contact pieces 212 at outer ends of the contact pieces 212 around the central shaft portion 211, and the binder 215 is C-shaped to thereby bind the contact pieces 212 at inner ends of the contact pieces 212 around the central shaft portion 211.

The first and second projecting portions 22*a* and 22*b* prohibits the movement of the connector terminal 20 in a length-wise direction. As illustrated in FIG. 1, each of the first and second projecting portions 22*a* and 22*b* is located adjacent to the first and second press-fit terminals 21*a* and 21*b*, respectively, and project beyond the first and second press-fit terminals 21*a* and 21*b* in a width-wise direction of the connector terminal 20. As explained later, each of the first and second projecting portions 22*a* and 22*b* makes abutment with an outer edge of later-mentioned first and second holders 410 and 420 of the connector housing 30, respectively.

The first projecting portion 22*a* located closer to the printed circuit board P1 (see FIG. 1) is designed longer in a length-wise direction of the connector terminal 20 than the second projecting portion 22*b* located closer to the printed circuit board P2, and is equal in length to the second projecting portion 22*b* in a width-wise direction of the connector terminal 20.

Since the first and second projecting portions 22*a* and 22*b* are formed of an elastic thin metal plate, they can accomplish the same performance as that of the buffer portion 23.

As illustrated in FIG. 4, the buffer portion 23 is located at a center of the connector terminal 20 between the first and second press-fit terminals 21*a* and 21*b*. The buffer portion 23 includes a plurality of elastic pieces 231, and binders 232 and 233 located at opposite ends of the elastic pieces 231. The elastic pieces 231 are equal in width to one another, equally spaced away from one another, and arranged in parallel with one another. The binders 232 and 233 are bent in the form of a U-shape such that they surround the longitudinal center line L1-L2 of the connector terminal 20. Since the elastic pieces 231 are bound such that the elastic pieces 231 are located at opposite ends 231*a* thereof in the vicinity of the longitudinal center line L1-L2 of the connector terminal 20, the elastic pieces 231 extend along and in parallel with the longitudinal center line L1-L2 of the connector terminal 20.

In the current embodiment, the three elastic pieces 231 are connected to the binders 232 and 233 such that the elastic pieces 231 are bound to be located close to one another. Hence, each of the three elastic pieces 231 makes uniform contact with each of three inner walls of the U-shaped binders 232 and 233.

For instance, in the case that the buffer portion 23 includes four or five elastic pieces 231, the binders 232 and 233 may be designed to have a rectangular or pentagonal cross-section, respectively. As an alternative, the binders 232 and 233 may be designed to be C-shaped or arcuate. It is preferable in such cases that the elastic pieces 231 are bound such that they are located at the opposite ends 231*a* thereof close to the longitudinal center line of the connector terminal 20, and extend in parallel with the longitudinal center line L1-L2 of the connector terminal.

Hereinbelow is explained a process of manufacturing the connector terminal 20, with reference to FIG. 5.

The connector terminal 20 is manufactured by bending a single elastic thin metal plate 210 illustrated in FIG. 5. The metal plate 210 is formed by punching a metal plate into a desired shape.

First, each of the central shaft portions 211 located at the opposite ends of the metal plate 210 is bent about the longitudinal center line L so as to have a U-shaped cross-section. Then, the U-shaped central shaft portion 211 is bent by 180 degrees towards the contact portion 213 about a line 241 horizontally extending between the central shaft portion 211 and the contact portion 213.

Then, the binders 214 and 215 extending in a direction perpendicular to the imaginary longitudinal center line L and defining outer edges of the contact portion 213 are bent into a C-shape, and the contact pieces 212 extending in parallel with the imaginary longitudinal center line L are bent into a barrel shape such that the resultant contact portion 213 surrounds the central shaft portion 211.

After a folding line is brought into the opposite ends 231*a* with central areas of the elastic pieces 231 being kept straight, the binders 232 and 233 extending in a direction perpendicular to the imaginary longitudinal center line L and defining outer edges of the buffer portion 23 are bent into a U-shape to thereby bind therewith the elastic pieces 231 extending in parallel with the imaginary longitudinal center line L.

Thus, there is completed the connector terminal 20 illustrated in FIG. 4.

The elastic pieces 231 are bound at the opposite ends 231*a* thereof by the bent binders 232 and 233 in the vicinity of the imaginary longitudinal center line L1-L2, as illustrated in FIG. 4. Thus, the elastic pieces 231 can be arranged in parallel with and in the vicinity of the imaginary longitudinal center line L1-L2 without being bent.

As illustrated in FIGS. 6 to 10, the connector housing 30 is formed by a resin injection process, and is substantially H-shaped. The connector housing 30 includes a main body 40 on which the connector terminals 20 are supported in a line, and a pair of legs 50 at each of opposite ends of the main body 40.

The main body 40 includes a terminal housing 400 in which the connector terminals 20 are housed, a base 401, and a pair of reinforcement walls 402 formed at opposite ends of the base 401 in a length-wise direction. The terminal housing 400 is formed at a side of the base 401.

The terminal housing 400 includes a plurality of first holders 410, a plurality of second holders 420, and a plurality of guide walls 430. Each of the guide walls 430 is located between each of the first holders 410 and each of the second holders 420. The first holders 410 are equally spaced away from adjacent ones, arranged in a line, and are elastically deformable in accordance with a deflection of the connector terminal 20. Similarly, the second holders 420 are equally spaced away from adjacent ones, arranged in a line, and are elastically deformable in accordance with a deflection of the connector terminal 20. The number of the first holders 410 and the number of the second holders 420 are equal to the number of the connector terminals 20. The first holders 410 are located nearer to the printed circuit board P1 than the second holders 420, and the second holders 420 are located nearer to the printed circuit board P2 than the first holders 410. The buffer portion 23 in each of the connector terminals 20 is located between the adjacent guide walls 430.

Figure 11:
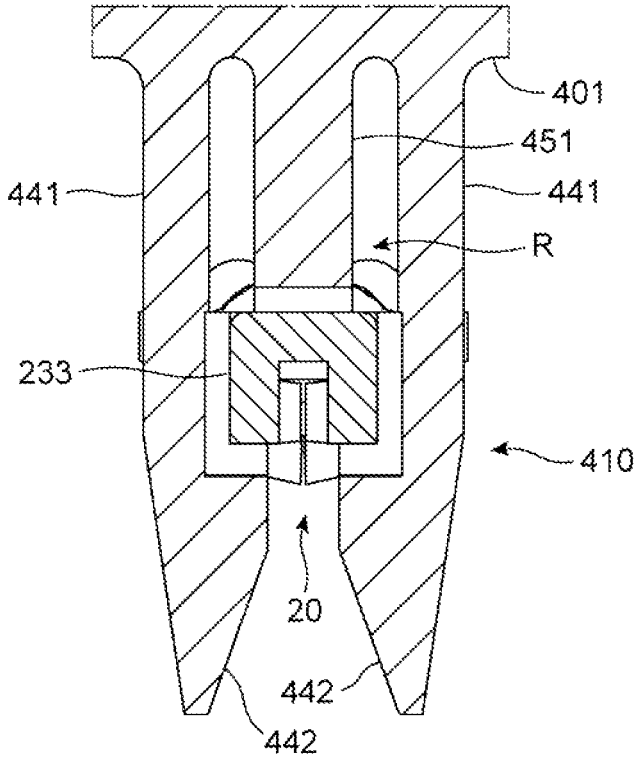
FIG. 11 is a cross-sectional view of the first holder.

As illustrated in FIG. 11, each of the first holders 410 includes a pair of arms 441 spaced away from each other and extending from the base 401 in parallel with each other, a pair of wedges 442 each formed at a distal end of the arm 441, and a first projection 451 extending from the base 401 between the arms 441 in parallel with the arms 441. The arms 441 and the wedges 442 are made of elastic material, and hence, are elastically deformable.

The wedges 442 inwardly project beyond the arms 441 towards each other. Between the arms 441 is formed a substantially rectangular space R in which the connector terminal 20 is housed. The first projection 451 is designed to have such a length that the first projection 451 does not make contact at a top thereof with the connector terminal 20 inserted into the space R.

As illustrated in FIG. 11, when the connector terminal 20 is inserted into the space R, the binder 23 of the buffer portion 23 does not make contact with the first projection 451, the arms 441 and the wedges 442.

Figure 12:
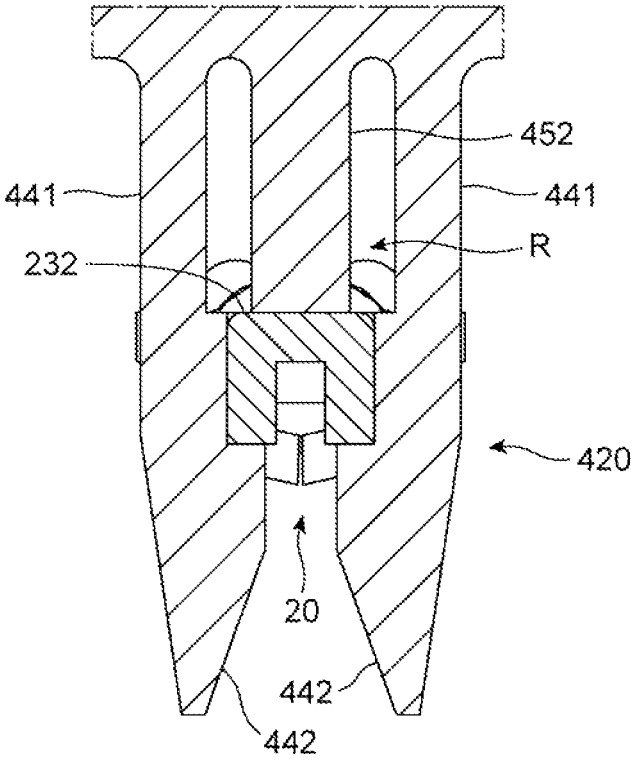
FIG. 12 is a cross-sectional view of the second holder.
Figure 13:
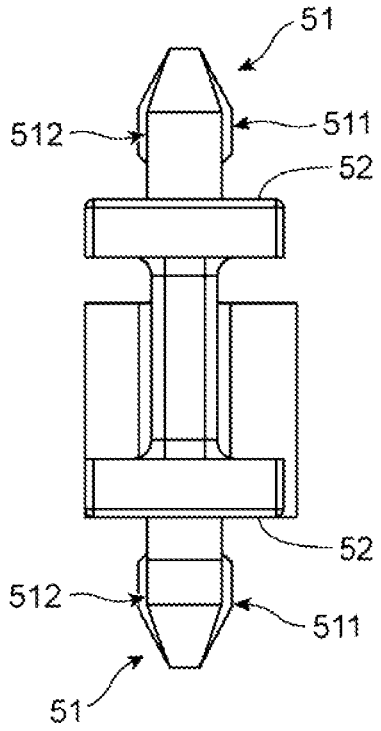
FIG. 13 is a side view of the connector housing illustrated in FIGS. 6 and 7.

As is obvious in view of comparison of FIG. 11 with FIG. 12, each of the second holders 420 is designed to have almost the same structure as that of the first holder 410 except that the arms 441, the wedges 442 and a second projection 452 are designed to make contact with binder 232 of the buffer portion 23, when the connector terminal 20 is inserted into the space R.

As illustrated in FIG. 11, each of the first holders 410 holds the first press-fit terminal 21*a* in a non-fixed condition. Specifically, a distance between the arms 441 in the first holder 410 is set to such a distance that the arms 441 do not make contact with the connector terminal 20 when the connector terminal 20 is inserted into the space R, and the first projection 451 in the first holder 410 is designed to have such a length that the first projection 451 does not make contact with the connector terminal 20 when the connector terminal 20 is inserted into the space R.

In contrast, as illustrated in FIG. 12, each of the second holders 420 holds the second press-fit terminal 21*b* in a fixed condition. Specifically, a distance between the arms 441 in the second holder 420 is set to such a distance that the arms 441 make contact with the connector terminal 20 when the connector terminal 20 is inserted into the space R, and the second projection 452 in the second holder 420 is designed to have such a length that the second projection 452 makes contact with the connector terminal 20 when the connector terminal 20 is inserted into the space R.

Herein, "each of the first holders 410 holds the connector terminal 20 in a non-fixed condition" means that though the connector terminal 20 is housed in the space R, the connector terminal 20 is able to move in the space R, and "each of the second holders 420 holds the connector terminal 20 in a fixed condition" means that the connector terminal 20 is housed in the space R such that the connector terminal 20 is not able to move in the space R.

Figure 6:
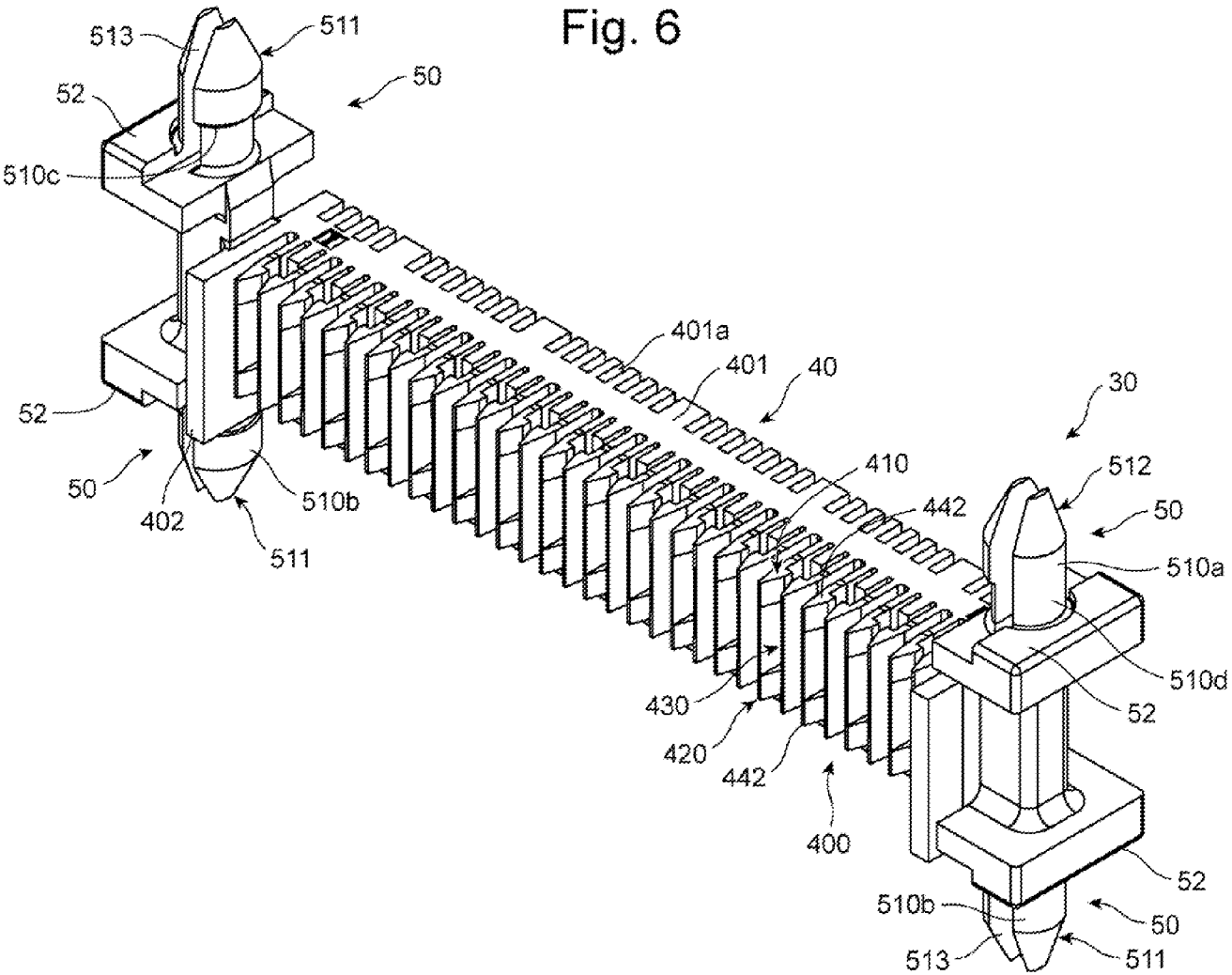
FIG. 6 is an upper perspective view of the connector housing defining a part of the electric connector in accordance with the first embodiment of the present invention.
Figure 7:
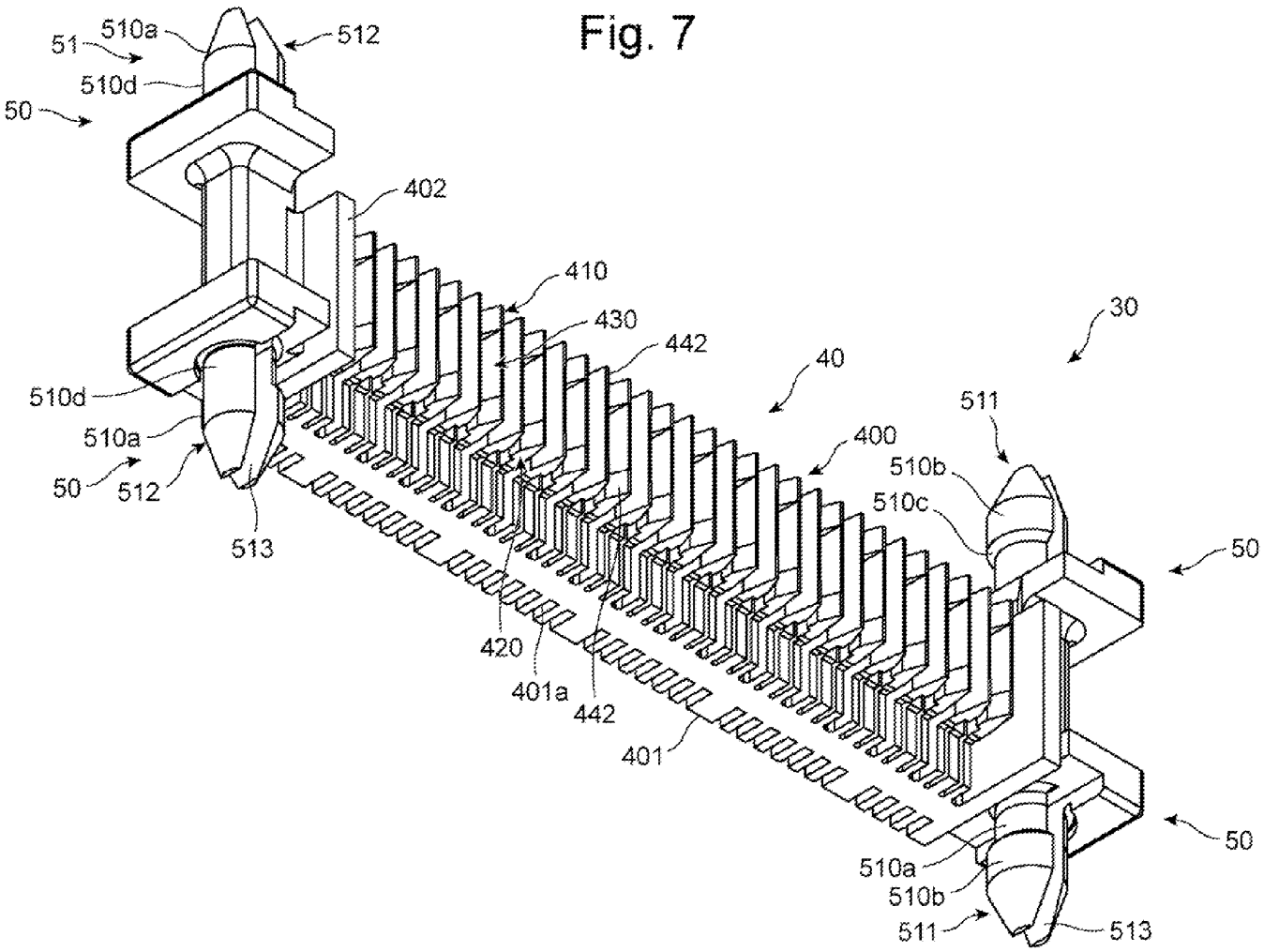
FIG. 7 is a lower perspective view of the connector housing defining a part of the electric connector in accordance with the first embodiment of the present invention.
Figure 8:
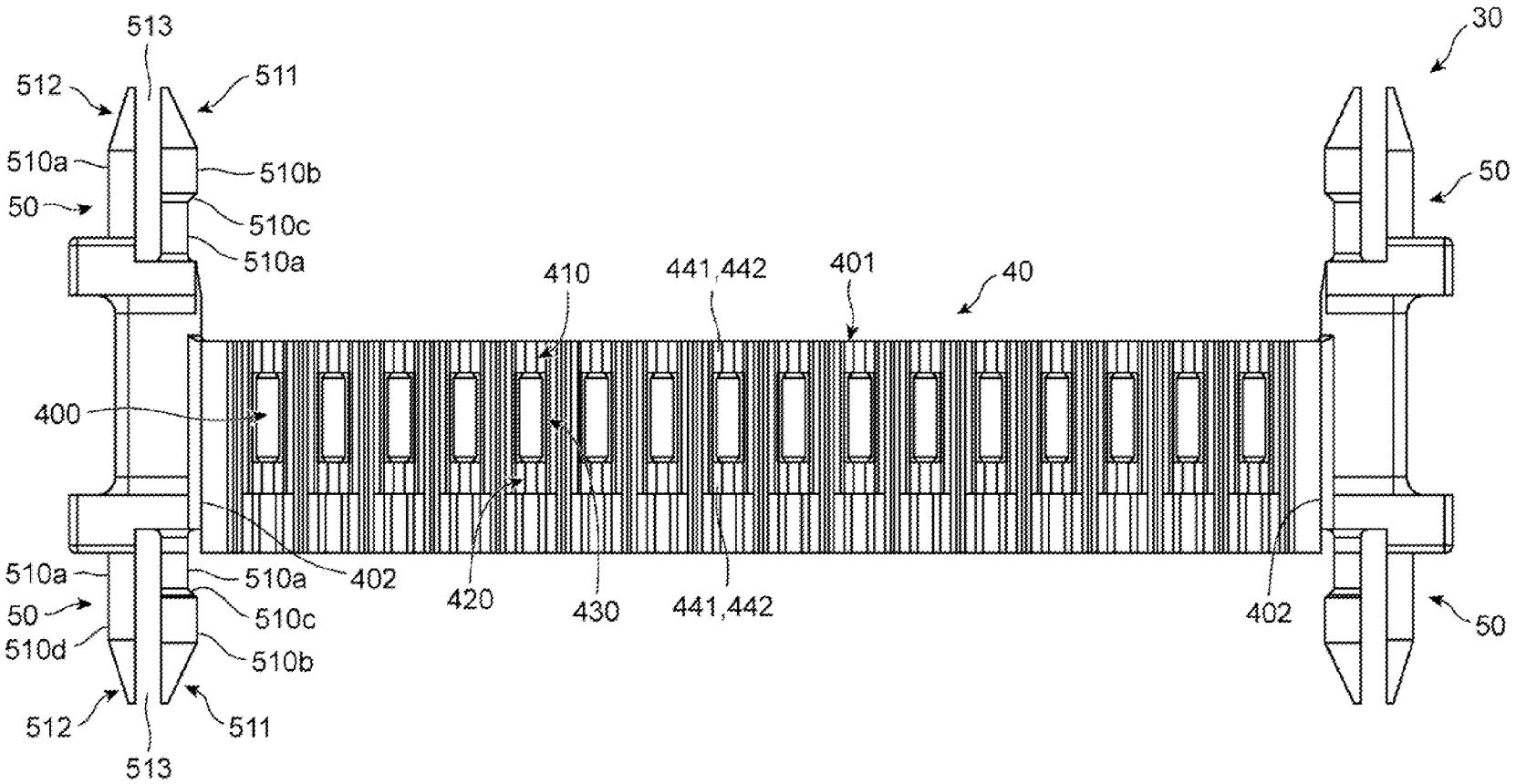
FIG. 8 is a front view of the connector housing illustrated in FIGS. 6 and 7.
Figure 9:
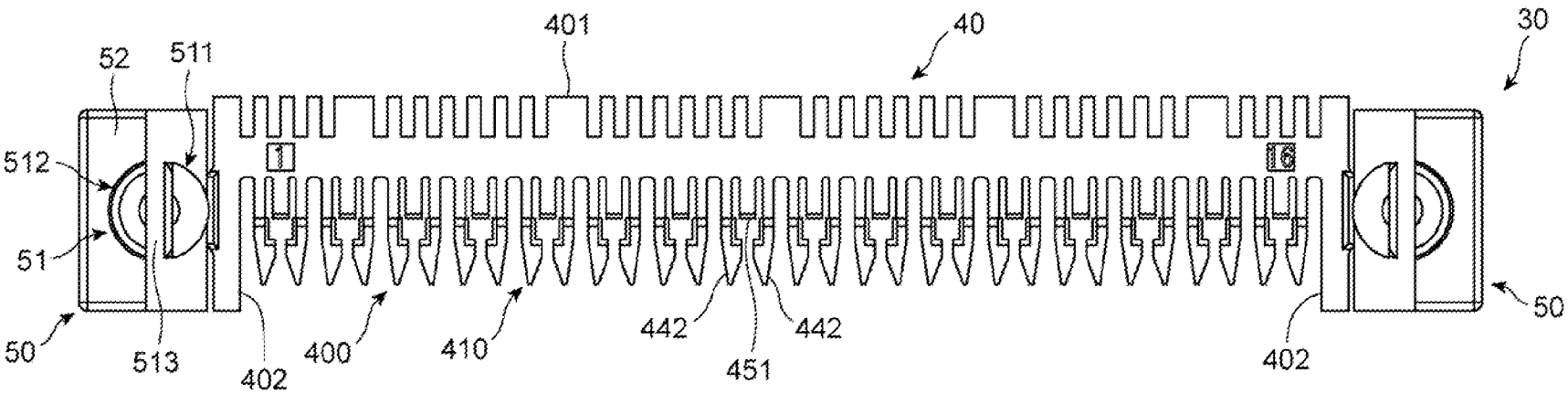
FIG. 9 is a plan view of the connector housing illustrated in FIGS. 6 and 7.
Figure 10:
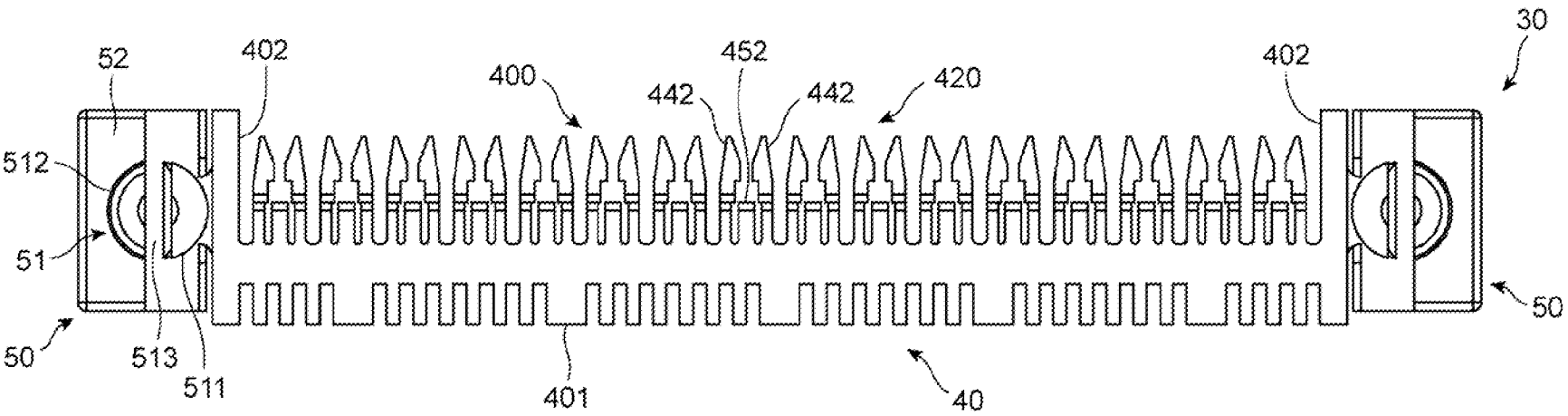
FIG. 10 is a bottom view of the connector housing illustrated in FIGS. 6 and 7.

As illustrated in FIGS. 6 to 8, each of the guide walls 430 is formed continuously and integrally between the first holder 410 and the second holder 420.

The base 401 is rectangular when viewed from the front. The base 401 is formed at one side thereof with the connector housing 400 and at the other side thereof with grooves 401*a* at a predetermined pitch. The grooves 401*a* extend in parallel with a longitudinal axis of the connector terminal 20 housed in the terminal housing 400. The grooves 401*a* formed at a predetermined pitch on the base 401 provide enhanced flexibility to the base 401 in a length-wise direction. Furthermore, since partition walls between which the grooves 401*a* are formed act as ribs, rigidity of the base 401 is enhanced in a direction perpendicular to a length-wise direction of the base 401.

Each of the reinforcement walls 402 projects forwardly beyond the base 401 at the opposite ends of the base 401. The reinforcement walls 402 provide enhanced rigidity to the base 401 in a direction perpendicular to a length-wise direction of the base 401.

As illustrated in FIGS. 1 and 13-15, each of the legs 50 includes a projection 51 divided into two portions, and a restrictor 52 making contact with surfaces Pa of the printed circuit boards P1 and P2 to thereby prohibit the projection 51 to further move.

The projection 51 is circular around a longitudinal axis thereof, and is divided by a predetermined circumferential angle into two portions, namely, a first projection portion 511 and a second projection portion 512. Each of the first and second projection portions 511 and 512 has a semicircular cross-section. A gap 513 is formed between the first and second projection portions 511 and 512.

Figure 14:
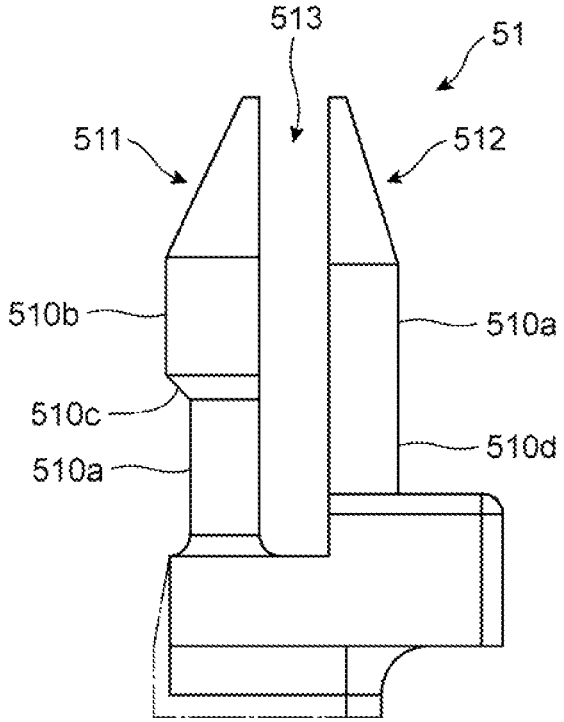
FIG. 14 is a front view of the leg of the electric connector.

As illustrated in FIG. 14, the first projection portion 511 has a shaft portion 510*a* having an expanded portion 510*b*. A tapered surface 510*c* formed adjacent to the expanded portion 510*b* is engaged with an edge Pc of a piercing hole Pb (see FIG. 1) of the printed circuit boards P1 and P2 to thereby restrict backward movement of the projection 51.

The second projection portion 512 makes contact with an inner surface of the piercing hole Pb through an outer surface of the shaft portion 510*a* thereof to thereby position the connector housing 30 relative to the printed circuit boards P1 and P2.

With respect to the electric connector 10 having the above-mentioned structure, a process of setting the connector terminals 20 into the connector housing 30 is explained hereinbelow.

When the connector terminals 20 are set into the connector housing 30, the connector terminals 20 are brought located in front of the connector housing 30. The buffer portion 23 of each of the connector terminals 20 is sandwiched between the adjacent guide walls 430.

Then, each of the connector terminals 20 is inserted into the first and second holders 410 and 420. When the connector terminal 20 is inserted into the space R through the wedges 442, the arms 441 are elastically deformed to thereby outwardly expand. Thus, even if a space between the wedges 442 is shorter than a width of the binders 232 and 233 of the buffer portion 23, the connector terminal 20 can be inserted into the first and second holders 410 and 420.

Since the arms 441 and the wedges 442 in the first and second holders 410 and 420 are made of elastic material, the wedges 442 move away from each other without exerting an excessive compressive force in the wedges 442, ensuring that the connector terminal 20 can be inserted into the first and second holders 410 and 420. Furthermore, when the arms 441 are elastically deformed to return to their initial positions, a space between the wedges 442 is shortened to thereby hold the connector terminal 20 between the arms 441.

Then, a process of inserting the connector terminals 20 into the printed circuit boards P1 and P2 is explained hereinbelow.

First, as illustrated in FIG. 1, the projections 51 are inserted into guide piercing holes Pb formed through the printed circuit board P2, and the second press-fit terminals 21*b* are inserted into the through-holes TH formed in line through the printed circuit board P2.

Figure 15:
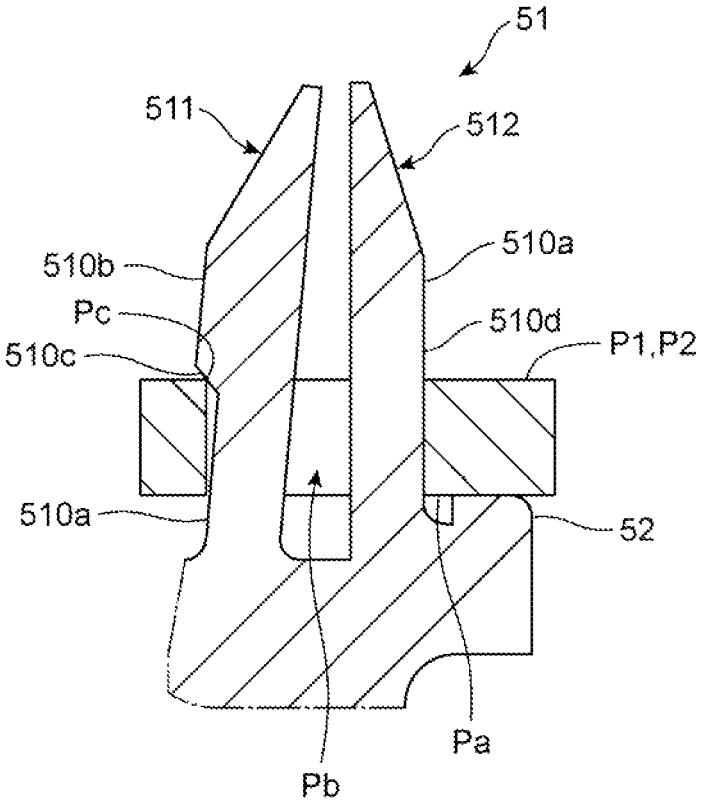
FIG. 15 is an enlarged view of the portion A shown in FIG. 1.

As illustrated in FIG. 15, inserting the projections 51 into the guide piercing holes Pb of the printed circuit board P2, the second projection portion 512 straightly forwards into the guide piercing hole Pb, sliding on an inner surface of the guide piercing hole Pb. Herein, an outer surface 510*a* of the shaft portion 510*a* acts as a guide 510*d*.

While the expanded portion 510*b* of the first projection portion 511 is going through the guide piercing hole Pb, the expanded portion 510 is deformed towards the gap 513. After the expanded portion 510*b* passes over the guide piercing hole Pb, the restrictor 52 makes abutment with a surface Pa of the printed circuit board P2 to thereby prohibit the projection 51 to further go forward, and the tapered surface 510*c* of the deformed first projection portion 511 compresses and engages with an edge Pc of the guide piercing hole Pb by virtue of an elastic force. In this situation, since the tapered surface 510*c* of the first projection portion 511 engages with the edge Pc of the guide piercing hole Pb, the projection 51 is prohibited from moving back.

Thus, the projection 51 is prohibited by the restrictor to go forward, and further, prohibited by the first projection portion 511 to move back, resulting in that the projection 51 is fixed to the printed circuit board P2.

As illustrated in FIG. 12, since the second holder 420 holds the connector terminal 20 in a fixed condition, when the second press-fit terminal 21*b* is inserted into the through-hole TH of the printed circuit board, there is no play between the connector terminal 20 and the connector housing 30, ensuring that the connector terminal 20 does not move. Thus, it is possible to simultaneously, smoothly and accurately insert a plurality of the second press-fit terminals 21*b* of the connector terminals 20 arranged in a line into the through-holes TH of the printed circuit boards.

Even if a stress acts on the connector terminal 20 towards a longitudinal center line thereof when the second press-fit terminal 21*b* is inserted into the through-holes TH of the printed circuit boards, the second projection portion 22*b* is engaged with the arms 441 and the wedges 442 of the second holder 420, and hence, the connector terminal 20 can be avoided from moving towards the longitudinal center line. Thus, since the connector terminal 20 does not move towards the longitudinal center line, the second press-fit terminal 21*b* can be smoothly inserted into the through-holes TH of the printed circuit board P2.

Then, after the printed circuit board P1 is positioned above the electric connector 10, the projections 51 are inserted into the guide piercing holes Pb of the printed circuit board P1, and the first press-fit terminals 21*a* are inserted into the through-hole TH formed in a line through the printed circuit board P1.

The projections 51 are inserted into the piercing holes Pb of the printed circuit board P1, similarly to the insertion of the projections 51 into the printed circuit board P2. As illustrated in FIG. 15, the second projection portion 512 goes forward in the piercing hole Pb, and the first projection portion 511 is inserted into the piercing hole Pb. Thus, the projections 51 are prohibited to move back. Furthermore, since the restrictor 52 makes abutment with the printed circuit board P1, the projections 51 are prohibited to go forward. Thus, the projections 51 are prohibited by the restrictor 52 to go forward, and further, are prohibited by the first projection portion 511 to move back, resulting in that the projections 51 are fixed to the printed circuit board P1.

Even if a positional relation between the printed circuit boards P1 and P2 were deflected when the first press-fit terminals 21*a* are inserted into the through-holes TH, since the first holder 410 holds the connector terminal 20 in a non-fixed condition, as illustrated in FIG. 11, the connector terminal 20 is able to move within the space R in the first holder 410, and hence, the first press-fit terminal 21*a* can be accurately positioned relative to the through-hole TH. Accordingly the first press-fit terminal 21*a* can be inserted into the through-holes TH without exerting much load onto the first press-fit terminal 21*a*.

Figure 16:
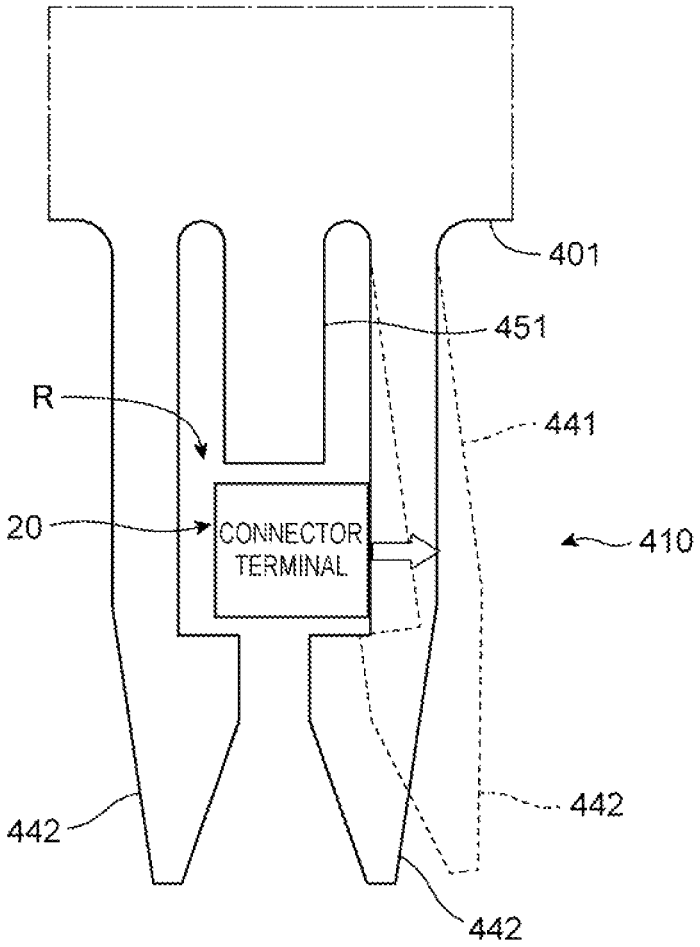
FIG. 16 illustrates the elastic deformation of the first holder.

In the case that there is much deflection in a positional relation between the printed circuit boards P1 and P2, and hence, the connector terminal 20 is deflected beyond an allowable range of the space R in the first holder 410, when the first press-fit terminal 21*a* is inserted into the through-hole TH, the arm 441 towards which the connector terminal 20 is deflected is outwardly deformed, as illustrated in FIG. 16. Thus, the connector terminal 20 can be deflected without being interfered, ensuring that the first press-fit terminal 21*a* can be inserted into the through-hole TH.

As illustrated in FIG. 4, each of the first and second press-fit terminals 21*a* and 21*b* is defined by the U-shaped central shaft portion 211 acting as a core or a reinforcement, and the contact pieces surrounding the central shaft portion 211 therewith. Thus, the first and second press-fit terminals 21*a* and 21*b* can be inserted into the printed circuit boards P1 and P2 without the longitudinal center lines L1 and L2 of the first and second press-fit terminals 21*a* and 21*b* being not curved. Furthermore, the first and second press-fit terminals 21*a* and 21*b* can make close contact with inner surfaces of the through-holes TH without being soldered to the through-holes TH by virtue of an elastic reaction force provided by the elastically deformed contact pieces 212, and thus, the first and second press-fit terminals 21*a* and 21*b* ensure electrical connection with the printed circuit boards P1 and P2.

As mentioned above, the electric connector 10 sandwiched between the printed circuit boards P1 and P2 is able to electrically connect the printed circuit boards P1 and P2 to each other.

For instance, if the electric connector 10 oscillates while being connected to the printed circuit boards P1 and P2, a positional relation between the printed circuit boards P1 and P2 is deflected. Since the connector terminal 20 is designed to include the buffer portion 23, even if a positional relation between the first and second press-fit terminals 21*a* and 21*b* were deflected, the buffer portion 23 would be elastically deformed to absorb the deflection in the positional relation.

Furthermore, since the arms 441 and the wedges 442 in the first and second holders 410 and 420 are made of elastic material, even if a positional relation between the printed circuit boards P1 and P2 were much deflected, the arm 441 on which a load is exerted by the connector terminal 20 is outwardly deformed to thereby allow the connector terminal 20 to be deflected.

Thus, even when a positional relation between the printed circuit boards P1 and P2 were deflected due to oscillation with the first and second press-fit terminals 21*a* and 21*b* being inserted into the printed circuit boards P1 and P2 and further with the connector housing 30 being fixed to the printed circuit boards P1 and P2, it is possible to reduce a load exerted by the connector housing 30 onto the connector terminals 20.

Since the connector terminal 20 can be smoothly deflected as a result of the elastic deformation of the first and second holders 410 and 420, even if a positional relation between the printed circuit boards P1 and P2 were deflected, the first and second press-fit terminals 21*a* and 21*b* can be surely inserted into the through-holes TH of the printed circuit boards P1 and P2, and further, can be kept inserted in the through-holes TH, ensuring stable connection between the first and second press-fit terminals 21*a* and 21*b* and the printed circuit boards P1 and P2.

Furthermore, since the arms 441 and the wedges 442 in the first and second holders 410 and 420 are made of elastic material, the connector terminal 20 can be caused to move, if one of the arms 441 and the wedges 442 outwardly expands, as illustrated in FIGS. 11 and 12. Thus, the first and second holders 410 and 420 can be readily elastically deformed in comparison with a ring-shaped holder.

The first and second projections 451 and 452 in the current embodiment are designed to project into the space R. As an alternative, the first projection 451 can be omitted, in which case, the arms 441 are designed to be shorter than the length illustrated in FIG. 11 by a length equal to a length of the first projection 451. As an alternative, the second projection 452 may be designed shorter than the length illustrated in FIG. 12 to such a length that the second projection 452 can fix the connector terminal 20, in which case, the arms 441 are designed also shorter in line with the reduced length of the second projection 452. It should be noted that the arms 441 can have a length equal to or greater than a sum of a length of the first or second projection 451 or 452 and a length of the connector terminal 20 by designing the first and second projections 451 and 452 to project into the space R, ensuring that the arms 441 can have a sufficient length. Consequently, the arms 441 and the wedges 442 can have sufficient elasticity, and hence, can be elastically deformed in accordance with the deflection of the connector terminal 20.

As illustrated in FIG. 12, the second holder 420 makes contact at a top thereof with the connector terminal 20. That is, the second holder 420 narrows the space R by means of a projecting length thereof to thereby fix the connector terminal 20. Hence, even if the connector terminal 20 compresses the second projection 452 in order to move towards the second projection 452, the second projection 452 is difficult to be deformed, because the second projection 452 is compressed in a length-wise direction. Accordingly, the second holder 420 stably holds the connector terminal 20 and prohibits the movement of the connector terminal 20, ensuring that the connector terminal 20 can be surely fixed.

The first and second projections 451 and 452 in the current embodiment are designed to project from the base 401 between the arms 441 in parallel with the arms 441. As an alternative, the first and second projections 451 and 452 may be designed to make at sides thereof with the connector terminal 20. A volume of the space R can be controlled by a location from which the first and second projections 451 and 452 extend.

Figure 17:
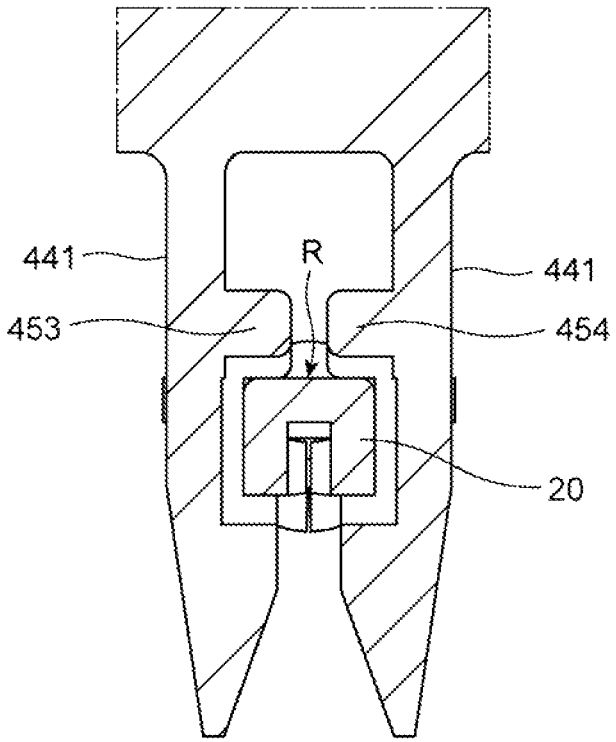
FIG. 17 is a cross-sectional view of a variant of the second holder.
Figure 18:
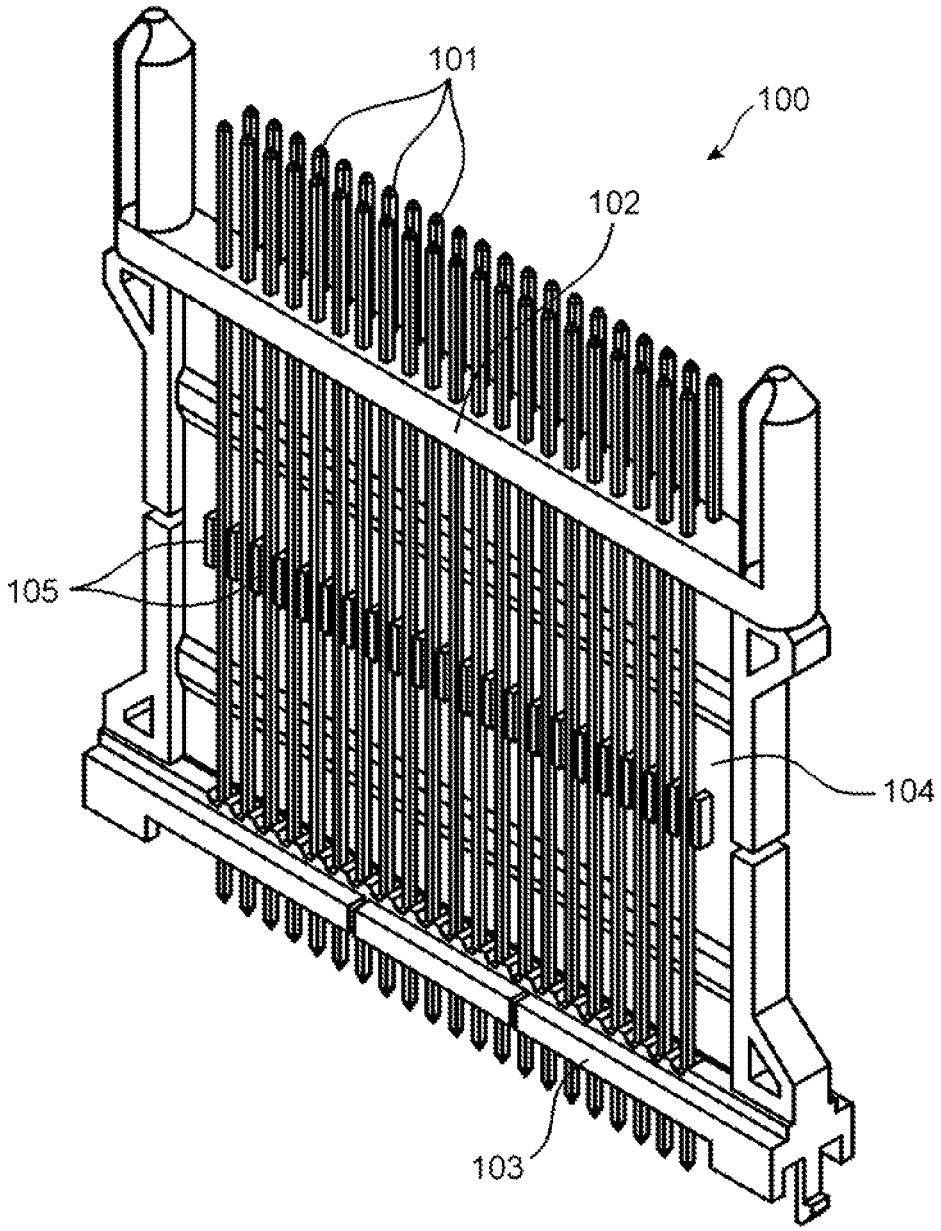
FIG. 18 is a perspective view of the conventional electric connector.

For instance, as illustrated in FIG. 17, third and fourth projections 453 and 454 may be formed in place of the first and second projections 451 and 452. The third and fourth projections 453 and 454 extend from the arms 441 towards each other into the space R, and are designed to make contact at a side (or a lower edge) thereof with the connector terminal 20. Since a volume of the space R may be increased or decreased by a location from which the third and fourth projections 453 and 454 extend, the third and fourth projections 453 and 454 can hold the connector terminal 20 in a non-fixed or fixed condition, similarly to the first and second projections 451 and 452.

By making a volume of the space R smaller by controlling a location from which the third and fourth projections 453 and 454 extend, it is no longer necessary to design the third and fourth projections 453 and 454 to have an increased length for keeping the connector terminal 20 in a fixed condition. Thus, it is possible to keep the connector terminal 20 in a fixed condition by means of the third and fourth projections 453 and 454 having a reduced length. Thus, even if the connector terminal 20 compresses the third and fourth projections 453 and 454 to move towards the third and fourth projections 453 and 454, the third and fourth projections 453 and 454 restrict the movement of the connector terminal 20, ensuring that the connector terminal 20 is surely kept in a fixed condition.

INDUSTRIAL APPLICABILITY

The present invention defines the electric connector capable of electrically connecting printed circuit boards to each other by inserting the press-fit terminals formed at opposite ends of the connector terminal, into through-holes formed through the printed circuit boards. Thus, the electric connector can be employed broadly in fields such as an electric/electronic industry and an automobile industry as a connector used for electric/electronic devices and fit into a printed circuit board, or a connector equipped in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A connector housing including a terminal housing in which at least one connector terminal configured to electrically connect two printed circuit boards to each other is housed, said terminal housing including a holder configured to hold said connector terminal, said holder being elastically deformable in accordance with a displacement of said connector terminal, said holder including a first holder configured to hold said connector terminal in a non-fixed condition, and a second holder configured to hold said connector terminal in a fixed condition, each of said first holder and said second holder including a pair of elastic arms, said first holder being configured to hold said connector terminal in such a manner that a gap is formed between said connector terminal and at least one of said pair of elastic arms of said first holder, said second holder being configured to hold said connector terminal in such a manner that no gap is formed between said connector terminal and said pair of elastic arms of said second holder, and said connector housing further comprising a pair of projections, each projecting from one of said pair of elastic arms of said second holder towards another one of said pair of elastic arms of said second holder in a space formed between said pair of elastic arms of said second holder, each of said pair of projections being configured to make contact at a side with said connector terminal, and said pair of projections being closer to a proximal end of said second holder than said connector terminal.

2. The connector housing as set forth in claim 1, wherein said pair of projections are collinear.

3. The connector housing as set forth in claim 1, wherein said pair of projections share a longitudinal axis.

4. The connector housing as set forth in claim 1, wherein each of said pair of projections is rectangular.

5. The connector housing as set forth in claim 1, wherein said connector terminal is disposed between said pair of projections and a distal end of each of said pair of elastic arms of said second holder.

6. An electric connector including:

at least one connector terminal configured to electrically connect two printed circuit boards to each other; and a connector housing including a terminal housing in which said connector terminal is housed, wherein said terminal housing includes a holder configured to hold said connector terminal, said holder being elastically deformable in accordance with a displacement of said connector terminal, wherein said holder includes a first holder configured to hold said connector terminal in a non-fixed condition, and a second holder configured to hold said connector terminal in a fixed condition, wherein each of said first holder and said second holder includes a pair of elastic arms, wherein said first holder is configured to hold said connector terminal in such a manner that a gap is formed between said connector terminal and at least one of said pair of elastic arms of said first holder, wherein said second holder is configured to hold said connector terminal in such a manner that no gap is formed between said connector terminal and said pair of elastic arms of said second holder, and wherein said connector housing further comprises a pair of projections, each projecting from one of said pair of elastic arms of said second holder towards another one of said pair of elastic arms of said second holder in a space formed between said pair of elastic arms of said second holder, each of said pair of projections being configured to make contact at a side with said connector terminal, and said pair of projections being closer to a proximal end of said second holder than said connector terminal.

7. The electric connector as set forth in claim 6, wherein said pair of projections are collinear.

8. The electric connector as set forth in claim 6, wherein said pair of projections share a longitudinal axis.

9. The electric connector as set forth in claim 6, wherein each of said pair of projections is rectangular.

10. The electric connector as set forth in claim 6, wherein said connector terminal is disposed between said pair of projections and a distal end of each of said pair of elastic arms of said second holder.

11. A method of inserting a connector terminal into a connector housing, said connector terminal being configured to electrically connect two printed circuit boards to each other, said connector housing including a terminal housing in which said connector terminal is housed, said terminal housing including a holder configured to hold said connector terminal, said holder being elastically deformable in accordance with a displacement of said connector terminal, said holder including a first holder configured to hold said connector terminal in a non-fixed condition, and a second holder configured to hold said connector terminal in a fixed condition, each of said first holder and said second holder including a pair of elastic arms, said first holder being configured to hold said connector terminal in such a manner that a gap is formed between said connector terminal and at least one of said pair of elastic arms of said first holder, said second holder being configured to hold said connector terminal in such a manner that no gap is formed between said connector terminal and said pair of elastic arms of said second holder, said connector housing further comprising a pair of projections, each projecting from one of said pair of elastic arms of said second holder towards another one of said pair of elastic arms of said second holder in a space formed between said pair of elastic arms of said second holder, and said pair of projections being closer to a proximal end of said second holder than said connector terminal, and said method including:

inserting said connector terminal into said holder included in said terminal housing, said holder being made of elastic material;

elastically deforming said holder in accordance with the displacement of said connector terminal to thereby cause said holder to hold said connector terminal; and causing each of said pair of projections to make contact at a side with said connector terminal.

12. The method of inserting a connector terminal into a connector housing as set forth in claim 11, wherein said pair of projections are collinear.

13. The method of inserting a connector terminal into a connector housing as set forth in claim 11, wherein said pair of projections share a longitudinal axis.

14. The method of inserting a connector terminal into a connector housing as set forth in claim 11, wherein each of said pair of projections is rectangular.

15. The method of inserting a connector terminal into a connector housing as set forth in claim 11, wherein said connector terminal is disposed between said pair of projections and a distal end of each of said pair of elastic arms of said second holder.

* * * * *